United States Patent [19]

Masson et al.

[11] 4,126,412

[45] Nov. 21, 1978

[54] METHOD FOR STABILIZING BRIGHTENED MODACRYLIC FIBERS

[75] Inventors: James C. Masson, Decatur, Ala.; George Palethorpe, Durham, N.C.

[73] Assignee: Monsanto Company, Decatur, Ala.

[21] Appl. No.: 830,738

[22] Filed: Sep. 6, 1977

Related U.S. Application Data

[63] Continuation-in-part of Ser. No. 645,106, Dec. 29, 1975, abandoned.

[51] Int. Cl.[2] ..... D06P 1/38

[52] U.S. Cl. ..... 8/1 W; 8/90; 8/163; 8/171; 8/177 R; 252/301.21; 252/301.25; 252/301.27; 260/45.7 P; 260/45.8 N; 260/45.8 NT

[58] Field of Search ..... 8/1 W, 177 R, 89 R, 8/89 A, 90, 163, 171; 252/301.21, 301.25, 301.27

[56] References Cited

U.S. PATENT DOCUMENTS 3,784,511 1/1974 Kirby ..... 8/177 R

OTHER PUBLICATIONS

Venkataraman's "The Chemistry of Synthetic Dyes," vol. V, (Academic Press, 1971), pp. 549, 556, and 611–616, and 669.

*Primary Examiner*—A. Lionel Clingman
*Attorney, Agent, or Firm*—Robert L. Broad, Jr.

[57] ABSTRACT

The method of preventing color-degrading interactions between certain optical brighteners and filaments made from a modacrylic polymer containing as a copolymer a halogenated ethylenically unsaturated monomer, the optical brightener preferably having the formula:

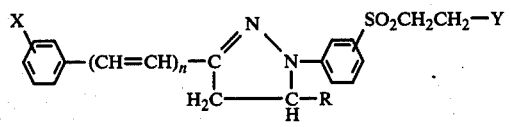

where X and Y are basic groups selected from the group consisting of $—NH_2$, $—H(CH_3)_2$, and $—N^+(CH_3)_3Z$, where Z is selected from the group consisting of chloride, sulphate and bromide anions, *n* is 0 to 3, and R is an alkyl group containing 1 to 4 carbon atoms, wherein an aqueous liquid is applied to the filaments, the liquid containing 0.01 to 0.5 weight percent of a compound having the formula:

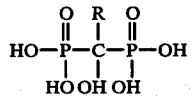

wherein R is a member selected from the group consisting of an alkyl radical having 1 to 11 carbon atoms, a phenyl radical and an alkyl phenyl radical containing no more than eight carbon atoms.

5 Claims, No Drawings

METHOD FOR STABILIZING BRIGHTENED MODACRYLIC FIBERS

CROSS-REFERENCE TO RELATED APPLICATION

This is a continuation-in-part application of application Ser. No. 645,106, filed Dec. 29, 1975 in the names of James C. Masson and George Palethorpe for "Method For Optically Brightening Modacrylic Filaments", now abandoned.

BACKGROUND OF THE INVENTION a. Field of the Invention

This invention relates to methods for preventing color degradation of optically brightened modacrylic filaments.

b. Description of the Prior Art

It is known to use certain organophosphorous compounds to enhance the heat stability of fibers or filaments from modacrylic polymers containing halogenated copolymers. One example of such an organophosphorous compound is 1-hydroxyethane 1, 1-diphosphonic acid. This compound is most effective for this purpose when added during or before the dope-making step of the fiber production so that the compound is incorporated into the polymer.

It would be expected that optical brighteners applied to the surface of the fibers would achieve the same result as the organophosphorous compound. However, it has been found that, when certain optical brighteners are used, there is apparently a color-degrading interaction between the brightener and the polymeric substrate which negates the effectiveness of the brightener.

SUMMARY OF THE INVENTION

The method of preventing color-degrading interactions between certain optical brighteners and filaments made from a modacrylic polymer containing as a copolymer a halogenated ethylenically unsaturated monomer, the optical brightener preferably having the formula:

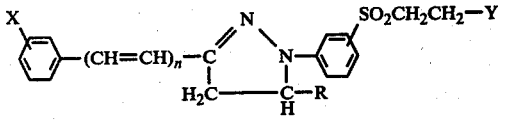

where X and Y are basic groups selected from the group consisting of $-NH_2$, $-H(CH_3)_2$, and $-N^+(CH_3)_3Z$, where Z is selected from the group consisting of chloride, sulphate and bromide anions, $n$ is 0 to 3, and R is an alkyl group containing 1 to 4 carbon atoms, wherein an aqueous liquid is applied to the filaments, the liquid containing 0.01 to 0.5 weight percent of a compound having the formula:

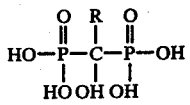

wherein R is a member selected from the group consisting of an alkyl radical having 1 to 11 carbon atoms, a phenyl radical and an alkyl phenyl radical containing no more than eight carbon atoms. The preferred compound is 1-hydroxyethane 1, 1-diphosphonic acid.

DETAILED DESCRIPTION OF THE INVENTION

In the present invention both the optical brightener and an organophosphorous compound described below may be applied to the filaments as the filaments are being passed through a conventional finish bath, the optical brightener and the organophosphorous compound being present in the bath. This is the most convenient way of carrying out the invention since the conventional fiber production line usually includes a finish bath somewhere in the line. However, a spray may be used to carry out the process of this invention, or the invention may be carried out by utilizing apparatus such as that disclosed in U.S. Pat. No. 3,791,788.

The filaments to be treated by the process of this invention are those formed from modacrylic polymers containing 35 to 85 weight percent acrylonitrile, 65 to 15 weight percent of a halogenated mono-olefinic monomer or monomers copolymerizable with acrylonitrile and, optionally, 0 to 50 weight percent of one or more other mono-olefinic monomers copolymerizable with acrylonitrile. Filaments of this type and methods of making them are old and well known in the art.

The optical brightener preferred for use with the modacrylic fiber has the general formula:

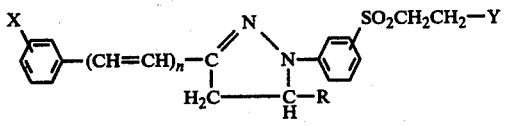

where X and Y are basic groups selected from the group consisting of $-NH_2$, $-NH(CH_3)_2$, and $-NH^+(CH_3)_3Z$, where Z is selected from the group consisting of chloride, sulphate and bromide anions, $n$ is 0 to 3, and R is an alkyl group having 1 to 4 carbon atoms.

The organophosphorous compound has the general formula:

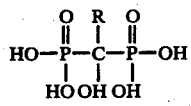

wherein R is a member selected from the group consisting of an alkyl radical having 1 to 11 carbon atoms, a phenyl radical and an alkyl phenyl containing no more than 8 carbon atoms. Examples of such organophosphorous compounds are the following:

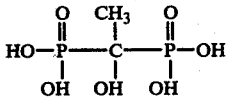

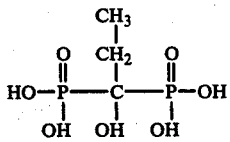

-continued

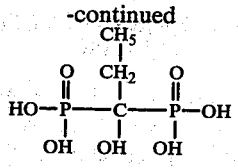

While the compounds identified above are suitable, the preferred organophosphorous compound is 1 hydroxyethane 1, 1-diphosphonic acid.

When the optical brightener and the organophosphorous compound are added to fibers from a bath, the bath should contain 50 to 2000 parts per million of the optical brightener, with a preferred range of 100 to 300 parts per million, and 0.01 to 0.5 weight percent of organophosphorous compound. Preferably, the solution will contain from 0.05 to 0.3 weight percent of the organophosphorous compound. The solution or bath to which these ingredients are added may be a conventional aqueous finish bath.

While the optical brightener described above is preferred for modacrylics, the process of the invention is effective with amine, imine, or ammonium substituted optical brighteners such as

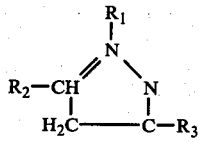

where $R_1$ is a phenyl radical, $R_2$ is hydrogen or an alkyl radical having 1 to 6 carbon atoms, a phenyl radical or a napthyl radical and $R_3$ is a phenyl or napthyl radical,

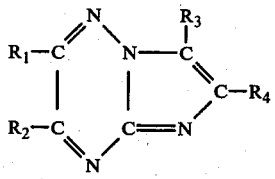

where $R_1$, $R_2$, $R_3$ and $R_4$ are hydrogen, an alkyl radical having 1 to 6 carbon atoms or a substituted or unsubstituted phenyl or napthyl radical, and

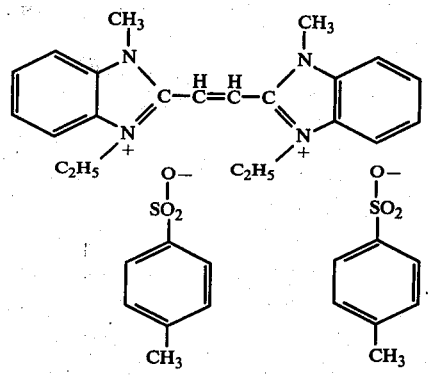

COMPARATIVE EXAMPLE I

Several runs were made to determine the color stability of optically brightened modacrylic filaments without the organophosphorous compound. Fibers were spun from a polymer made of about 66 weight percent acrylonitrile, 20 weight percent vinylidene chloride, 10 percent vinyl bromide, 1 percent styrene and 2 percent of a sulfonate monomer. This polymer contained 0.25 weight percent of 1-hydroxyethane 1, 1-diphosphonic acid as a color stabilizer. Treatment of the filaments was carried out in a bath containing a conventional fiber finish. The optical brightener used has the formula:

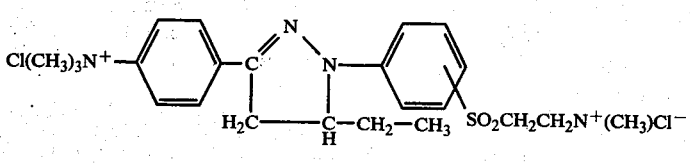

The following results were obtained:

| | Optical Brightener | Purity | Brightness | DWL |
|---|---|---|---|---|
| Run A | None | 7.0 | 75.0 | 572 |
| Run B | 100 PPM | 5.8 | 73.7 | 573 |
| Run C | 100 PPM | 6.8 | 75.6 | 573 |

The data for purity, brightener and dominant wave length (DWL) was obtained on a Color Eye spectrophotometer. It will be noted that purity and brightness, which are indicators of fiber color, in Runs B and C were not significantly better than in Run A where no optical brightener was used. There is apparently some color-degrading interaction between the brightener and the polymeric substrate which negates the effectiveness of the brightener.

EXAMPLE II

Example 1 was repeated using 200 parts per million of the same optical brightener in the finish bath and varying weight percentages of the organophosphorous compound. The following data was obtained.

| | Organophosphorous Weight Percent | Purity | Brightness | DWL |
|---|---|---|---|---|
| Run D | None | 7.7 | 76.0 | 570 |
| Run E | 0.25 | 2.7 | 79.3 | 564 |
| Run F | 0.05 | 2.6 | 76.7 | 571 |
| Run G | 0.1 | 1.7 | 77.6 | 570 |

It will be noted that in Runs E, F and G where both the optical brightener and the organophosphorous compound were used the fiber purity is significantly better than the other runs where both of these components were not used and decidedly superior to the brightened fibers enumerated in comparative Example I.

What is claimed is:

1. The method of preventing color-degrading interactions between certain optical brighteners and filaments made from a polymer made up of 35 to 85 weight percent acrylonitrile, 65 to 15 weight percent of a halogen-containing ethylenically unsaturated monomer and up to 50 weight percent of at least one other monomer copolymerizable with acrylonitrile, said optical brightener being selected from the group consisting of

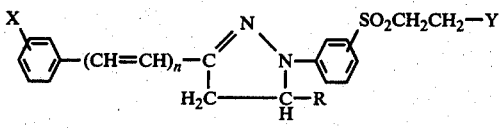

where X and Y are basic groups selected from the group consisting of $—NH_2$, $—N(CH_3)_2$, and $—N^+(CH_3)_3Z$, where Z is selected from the group consisting of chloride, sulphate or bromide anions, R is an alkyl group containing 1 to 4 carbon atoms and $n$ is 0 to 3,

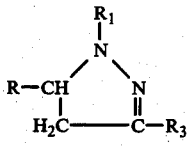

where $R_1$ is a phenyl radical, $R_2$ is hydrogen or an alkyl radical having 1 to 6 carbon atoms, a phenyl radical or a napthyl radical and $R_3$ is a phenyl or napthyl radical,

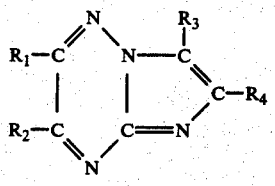

where $R_1$, $R_2$, $R_3$ and $R_4$ are hydrogen, an alkyl radical having 1 to 6 carbon atoms or a substituted or unsubstituted phenyl or napthyl radical, and

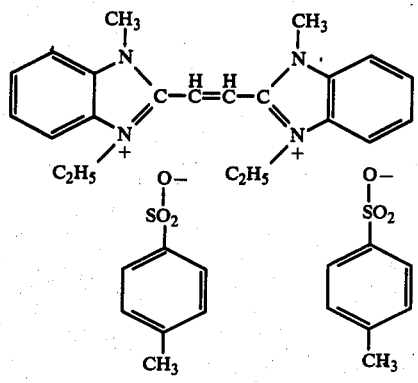

comprising contacting the filaments with a bath containing 0.01 to 0.5 weight percent of an organophosphorous compound having the formula

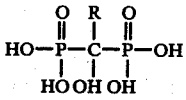

wherein R is a member selected from the group consisting of an alkyl radical having 1 to 11 carbon atoms, a phenyl radical and an alkyl radical containing no more than eight carbon atoms.

2. The method of claim 1 wherein the filaments are passed through a bath containing the organophosphorous compound.

3. The method of claim 2 wherein the bath contains 0.05 to 0.3 weight percent of the organophosphorous compound.

4. The method of claim 3 wherein the optical brightener is

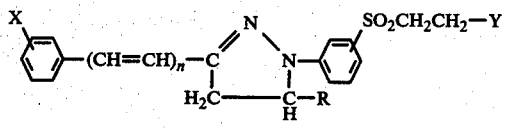

where X and Y are basic groups selected from the group consisting of $—NH_2$, $—N(CH_3)_2$, and $—N^+(CH_3)_3Z$, where Z is selected from the group consisting of chloride, sulphate and bromide anions, R is an alkyl group containing 1 to 4 carbon atoms and $n$ is 0 to 3.

5. The method of claim 4 wherein the organophosphorous compound is 1-hydroxyethane 1, 1-diphosphonic acid.

* * * * *

UNITED STATES PATENT OFFICE

CERTIFICATE OF CORRECTION

PATENT NO. : 4,126,412

DATED : November 21, 1978

INVENTOR(S) : James C. Masson and George Palethorpe

It is certified that error appears in the above-identified patent and that said Letters Patent are hereby corrected as shown below:

The formula in Claim 1, Column 5, line 30 read---

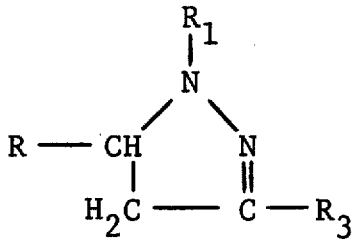

It should read:

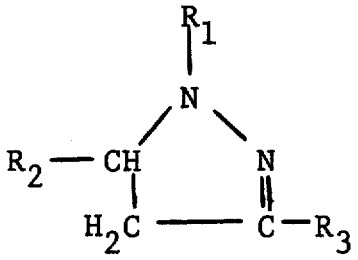

UNITED STATES PATENT OFFICE

CERTIFICATE OF CORRECTION

PATENT NO. : 4,126,412

DATED : November 21, 1978

INVENTOR(S) : James C. Masson and George Palethorpe

It is certified that error appears in the above-identified patent and that said Letters Patent are hereby corrected as shown below:

Claim 1, Column 6, line 28, read--- phenyl radical and an alkyl radical containing no more---

It should read--- phenyl radical and an alkyl phenyl radical containing no more---.

Signed and Sealed this

Tenth Day of April 1979

[SEAL]

Attest:

RUTH C. MASON
Attesting Officer

DONALD W. BANNER
Commissioner of Patents and Trademarks